US005472130A

United States Patent [19]

Beringhause et al.

[11] Patent Number: 5,472,130

[45] Date of Patent: Dec. 5, 1995

[54] POWERED FASTENER INSERTING MACHINE

[75] Inventors: Gerald D. Beringhause, North Hills; Charles Block, North Bellmore, both of N.Y.

[73] Assignees: Texpak, Inc., Franklin Square; Joseph Galkin Corporation, Hicksville, both of N.Y.

[21] Appl. No.: 312,471

[22] Filed: Sep. 26, 1994

[51] Int. Cl.[6] ..... B65C 7/00

[52] U.S. Cl. ..... 227/67; 227/156; 173/65; 173/73

[58] Field of Search ..... 173/59, 64, 65, 173/72, 73, 77, 79, 197, 199; 227/67, 68, 2, 156; 15/256.5; 83/144, 145

[56] References Cited

U.S. PATENT DOCUMENTS

| | | | |
|---|---|---|---|
| 777,311 | 12/1904 | Sergeant | 173/64 |
| 3,103,666 | 9/1963 | Bone . | |
| 3,470,834 | 10/1969 | Bone . | |
| 3,528,331 | 9/1970 | Ikelheimer | 83/145 |
| 3,734,375 | 5/1973 | Bone et al. . | |
| 3,735,908 | 5/1973 | Kinney et al. . | |
| 3,880,339 | 4/1975 | Bone | 227/67 X |
| 4,215,807 | 8/1980 | Ritter et al. . | |
| 4,315,587 | 2/1982 | Ritter et al. . | |
| 4,880,065 | 11/1989 | McDonald et al. | 173/63 X |
| 4,884,484 | 12/1989 | Bakermans et al. | 83/145 |
| 5,191,672 | 3/1993 | Boston et al. | 15/256.5 |

FOREIGN PATENT DOCUMENTS 674464 6/1952 United Kingdom .

OTHER PUBLICATIONS

Avery–Dennison "Dennison Swiftach Systems" brochure, distributed by Texpak, Inc., undated.

*Primary Examiner*—Rinaldi I. Rada
*Assistant Examiner*—Jay A. Stelacone
*Attorney, Agent, or Firm*—Harold James; Robert L. Epstein; James and Franklin

[57] ABSTRACT

A powered machine for inserting an attachment member having a filament with a head at one end through an opening in an article and including a needle which is projected from machine in order to penetrate that article and convey the filament head therethrough, in which the needle is cleaned during each actuation thereof by being wiped and/or having a jet of fluid blown across it, and in which the machine is provided with structure for grasping a tag which is to be penetrated by the needle, holding the tag in position while the needle penetrates it, and permitting the release of the tag after the fastening operation has been completed, all with positiveness and facility of manipulation.

8 Claims, 3 Drawing Sheets

POWERED FASTENER INSERTING MACHINE

The present invention relates to improvements in powered machines for inserting attachment members, usually formed of flexible plastic, into articles, which machines, well known in the art, comprise hollow needles which are projected into the article and usually through a tag or other object designed to be secured to that article by the attachment member. Those machines include a plunger reciprocated through the needle, to insert the head end of the flexible plastic member through the article to a position on the far side of the article, the body of the member passing through the tag and thus securing the tag to the article. The term "tag" will be here used generically to refer to any object designed to be secured to an article by the attachment member. The present invention provides means for keeping the needle clean so that it can perform its various functions efficiently and also provides means for permitting the tag to be secured to the machine in proper position and enabling the machine to be separated from the tag after the attachment process has been completed, all in a particularly facile manner.

Classic attachments having heads at both ends of a flexible filament and designed to penetrate an article and a tag, thereby to secure the tag to that article, are well known to the art, as are machines for effecting the attachment procedure. Reference in that regard may be made to Bone U.S. Pat. No. 3,103,666 of Sep. 17, 1963 entitled "Tag Attaching Apparatus". The apparatus of that Bone patent is actuated by hand. It has also long been known to provide apparatus of that type which is artificially powered, and in that regard reference may be made to Bone et al. U.S. Pat. No. 3,734,375 of May 22, 1973 entitled "Fastener Inserting Machine". In that particular machine a pair of relatively movable jaws are provided for clamping therebetween the articles and the tags through which the fasteners are to be passed, but there have also been similar powered machines on the market with only a single and stationary jaw which is designed to be placed up against the articles and the tags to be attached thereto. Typical of the first type of powered machine is that designated PS 100 by Avery-Dennison, and typical of the second type of machine is that designated PS 500 by the same company, which may be described as a complete hand-held unit with a blunt nose for applications where clamping action is not required.

Since the attachments and the machines of the type in question are often used commercially to accomplish a very large number of attaching operations in as short a period of time as possible, thereby to minimize the cost of manufacture and distribution, it is important that the devices operate reliably and rapidly over long periods of time, and that when tags are to be attached to articles those tags be accurately positioned with respect to the attaching apparatus and then separated from that apparatus after attachment has been completed, all with as great speed and involving as little possibility of error as possible. The problem of tag location is particularly important when, as is usually the case, the tag is provided with a pre-formed aperture through which the inserted attachment is to pass.

Often the tag is to be secured to an article which itself may contaminate the attaching apparatus. For example, when one wishes to attach a tag to a flexible plastic plant container or other article which may contain material such as soil, the needle, when it penetrates the container, moves into the container contents and picks up particles of soil or the like which will tend to clog the internal portions of the needle and thus prevent proper movement of the fastener head and/or head-moving plunger therethrough, or destroy the smoothness of the outer surface of the needle, making it either more difficult for the needle to penetrate the next article or causing that penetration to produce a larger than desired hole in the article wall. In addition, contaminants which enter the interior of the needle may also travel into the interior of the needle-moving mechanism, eventually causing malfunction of the latter.

With respect to the proper location of the tag before attachment, particularly with the non-clamping type of unit exemplified by Avery-Dennison model PS 500, the only practical way of attaching a tag properly is to initially insert it between the needle and the blunt nose and move it over the needle before each attachment operation. This is a somewhat time-consuming operation, and, moreover, when the attachment operation has been completed, one must be careful when moving the machine away from the article because the tag is located between the blunt nose and the retracted needle. This is further time-consuming, in addition to requiring a significant degree of care and skill.

The machine of the present invention, here shown as of the non-clamping type as exemplified by Avery-Dennison model PS500, is provided with means for cleaning the needle, preferably both positively by wiping and also by blowing a blast of fluid thereover, during each operation thereof, thereby effectively to prevent contamination or damage to the needle and the other functional components of the machine. In addition, a tag clip is provided on the front of the blunt nose and on its exposed front side for the purpose of grasping a tag and holding it in position on that exposed front side of the nose. The tag can be put in place without having to take the position of the needle into account at all, and once the attaching operation is completed the machine can simply be moved away, the attached tag separating from the machine, in a completely facile manner.

It is therefore the object of the present invention to improve a powered tag attaching apparatus by automatically cleaning the needle during each operation thereof without in any way complicating the manipulation and use of the apparatus, and to greatly facilitate the accurate locating of tags to be attached relative to the attaching apparatus without inhibiting or making more complex the manipulation of that apparatus during attaching operations.

To the accomplishment of the above, and to such other objects as may hereinafter appear, the present invention relates to an improved powered fastener inserting and tag attaching apparatus as defined in the following claims and as described in this specification, taken together with the accompanying drawings, in which:

Figure 1:
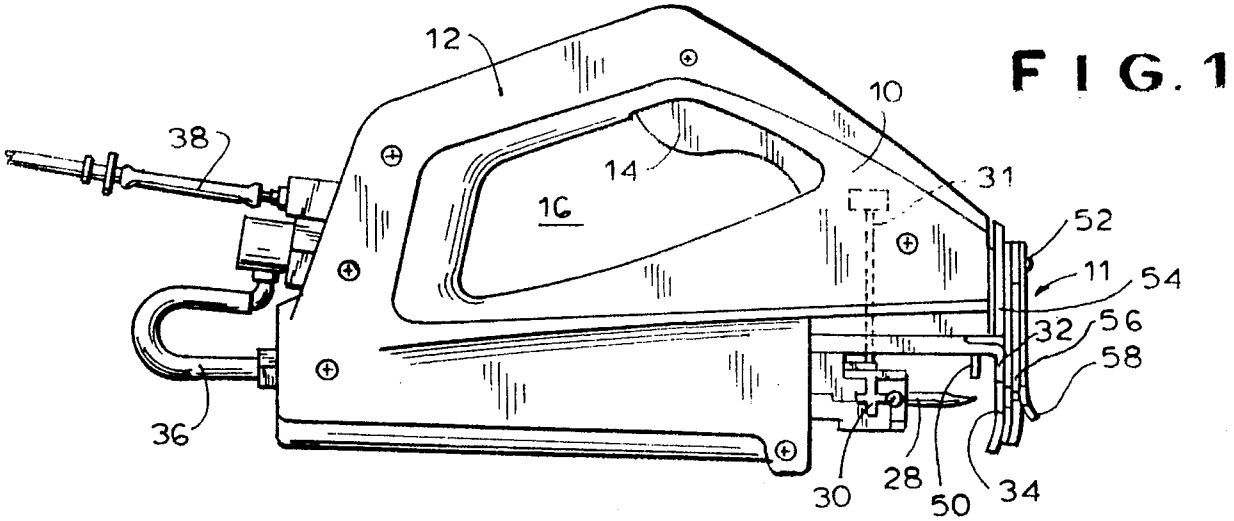
FIG. 1 is a side elevational view of the tag attaching apparatus of the present invention, a modified Avery-Dennison model PS 500 hand-held powered attachment.

As is conventional, the apparatus comprises a housing 10 having a blunt nose 11 and including a handle portion 12 for permitting a person to hold the device. In order to control the operation of the device a control member 14 extends within the hand opening 16, is pivotally mounted at 18 and has a linkage rod 20 extending therefrom which engages the operating button 22 of a four-way spring return, trigger operated valve 24.

Figure 2:
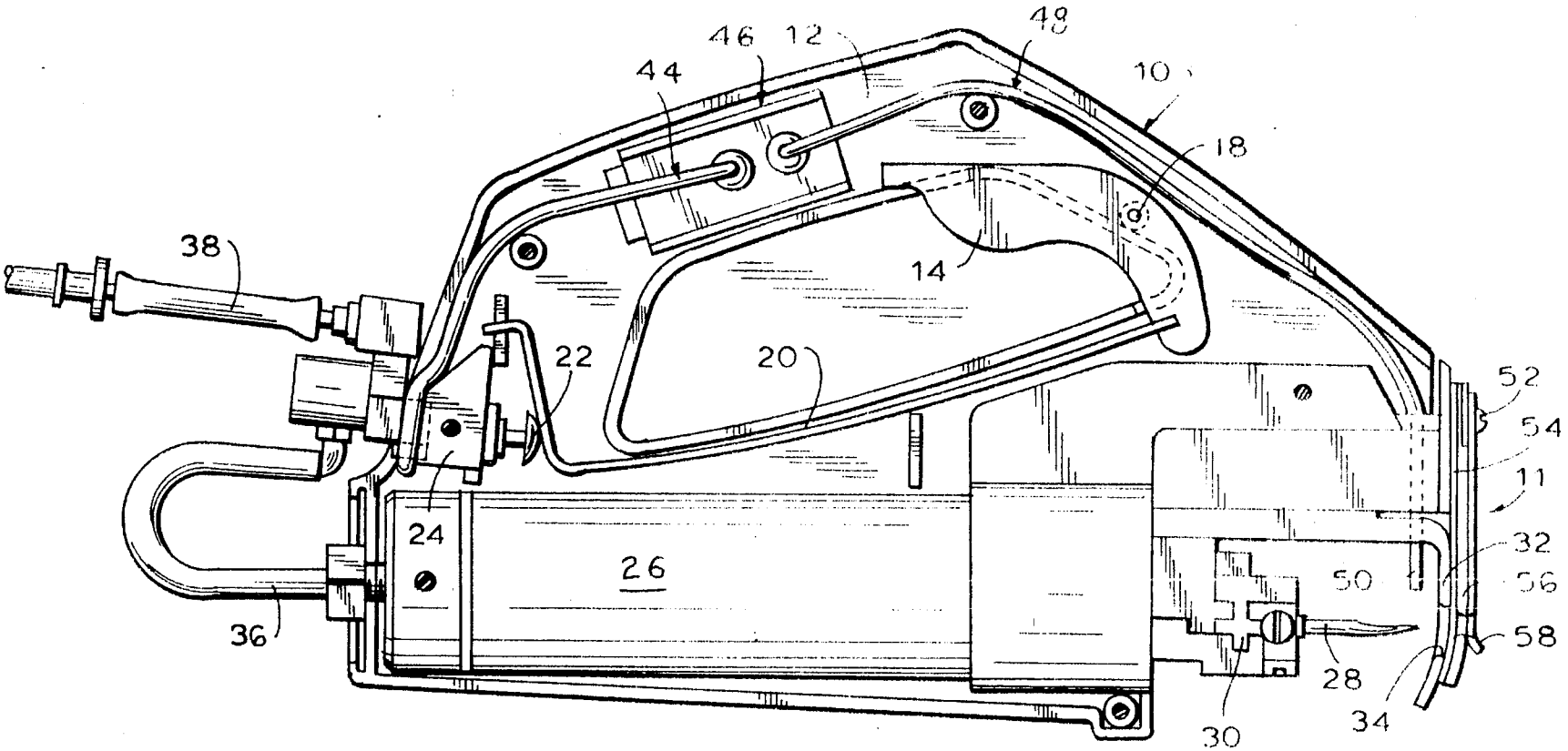
FIG. 2 is a view of the machine of FIG. 1 on an enlarged scale and with the side cover removed.

Within the housing 10 is located a container 26 for the operating mechanism of the apparatus, from which housing 26 a needle 28 extends. As is more completely disclosed in Bone et al. U.S. Pat. No. 3,734,375, that needle is provided with a slot 30 into which the head of a plastic fastener 31 (schematically indicated in broken lines in FIG. 1) is adapted to be fed. It is further provided with a plunger (not shown) for pushing the fastener head through the needle 28, and means are provided within the housing 26 for moving the needle 28 together with its plunger and the fastener head from its retracted position shown in FIGS. 1 and 2, in which it is located to the left of downwardly depending stationary nosepiece 32, and a projected position passing through and beyond an opening 34 in the nosepiece 32. The mechanism for performing those functions when fluid under pressure is provided by a conduit 36 is the mechanism employed in the Avery-Dennison model PS 500 which has long been on the market and is as is shown in the aforementioned Bone '375 patent, except that the movable jaw and actuating mechanism therefor shown in that patent is not present.

Figure 5:
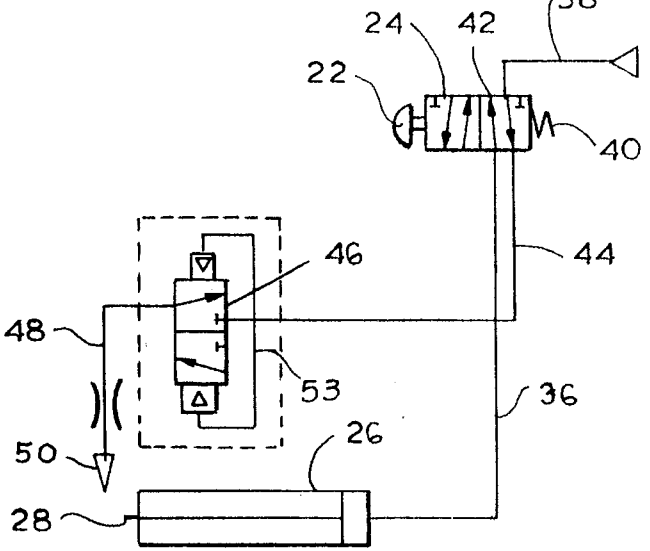
FIG. 5 is a schematic view of the novel fluid system embodied in the apparatus.

In accordance with the present invention, suitable fluid under pressure is supplied via conduit 38 to the valve 24, and an outlet from that valve 24 is connected to conduit 36 leading to the housing 26. When the button 22 of the valve 24 is in its normal outer position, pushed there by spring 40, that being the position shown in FIGS. 1, 2 and 5, the conduit 36 is vented at 42, thus causing the needle 28 and associated equipment to be in their normal standby position shown in FIGS. 1 and 2. At the same time the pressure fluid source 38 is connected by the valve 24 to conduit 44 which leads to pulse valve 46. This valve is of a conventional type which has the characteristic of assuming a normal condition and upon receiving a signal provided by a fluid pulse assuming a second position for a predetermined period of time and then automatically returning to its normal position. In FIG. 5 the pulse valve is shown in its normal position in which the fluid pressure from conduit 44 is blocked and in which conduit 48, which leads from the valve 46 to the nozzle 50 located just above the path of the needle 28, is vented.

When the handle 14 is manually activated and the valve button is pushed inwardly against the action of the spring 40, the condition of valve 24 changes so as to connect conduit 36 to the fluid pressure source 38 and at the same time vent conduit 44. Fluid pressure applied to the operating mechanism in housing 26 via the conduit 36 causes the needle 28 and its associated apparatus to function, the needle 28 passing through and projecting beyond the nosepiece 32 and ejecting the fastener head through the needle 28, all as is well known in the art. At the same time the conduit 44 will be vented, and this will have the effect of preparing the pulse valve 46 for operation, but it will still remain in its position shown in FIG. 5.

After the attaching operation has been completed the operator will release handle 14, the valve button 22 will be moved outwardly by the spring 40, and the valve 24 will return to its condition shown in FIG. 5. The conduit 36 will again be vented and hence the needle 28 will be withdrawn and its associated apparatus repositioned for subsequent actuation. The conduit 44 will be reconnected to the fluid pressure source 38, thus providing a pulse of pressure to pulse valve 46, as soon as the needle 28 begins to withdraw. That will cause pulse valve 46 to move to its second position in which the conduit 44 will be connected to the conduit 48. As a result fluid under pressure will flow from source 38 through valve 24, conduit 44, valve 46 and conduit 48 to nozzle 50, where it will blow over the needle 28 as it is being retracted. That flow will continue for a period of time predetermined by the pulse valve 46, after which that valve 46 will return to its first position as shown in FIG. 5, terminating fluid flow through conduit 48 and nozzle 50. The way in which pulse valves of the type under discussion function is well known, it being sufficient to say that in one type of pulse valve the time duration is accomplished by a restricted bleed-through process, as indicated by the line 53 in FIG. 5. The fluid flows over the needle 28 while it is extended and during at least a portion of its withdrawal from that extended position, thereby to blow away foreign particles which may be present.

Figure 4:
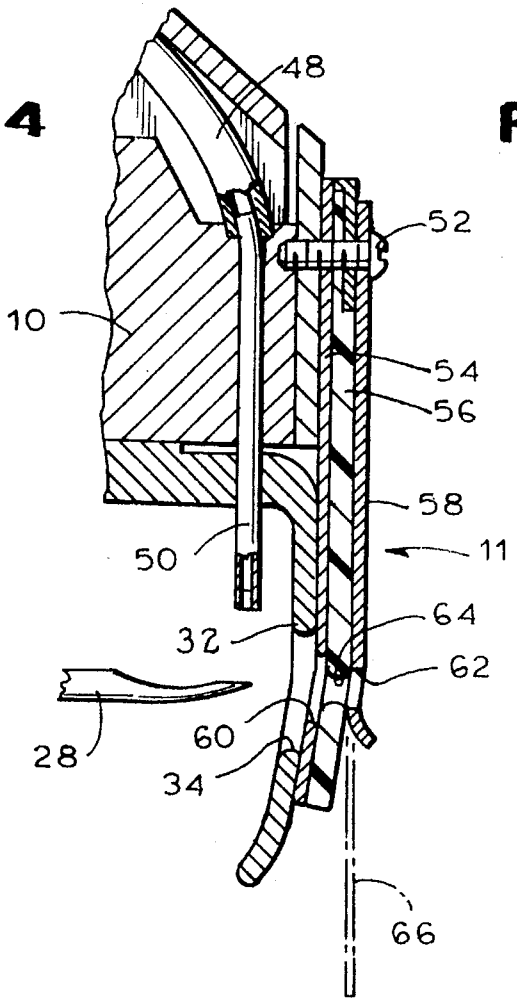
FIG. 4 is a cross-sectional view taken along the line 4—4 of FIG. 3.

Further, and as may best be seen from FIGS. 4 and 5, the forward portion of the housing 10 adjacent the nosepiece has secured thereto, as by screws 52, a metal support plate 54, a relatively thick sheet 56 of neoprene or similar soft material, and an outer resilient metal strip 58. All of these elements extend down to the vicinity of the opening 34 in the nosepiece 32, sheet 54 is provided with an opening 60 through which the needle 28 may freely pass, the outer metal strip 58 is provided with an opening 62 preferably smaller than the opening 60 but still larger than the cross-section of the needle 28, and the neoprene sheet 56 is provided with an opening 64 which is slightly smaller in cross-section than the needle 28. The neoprene sheet 56 is confined between the metal strips 54 and 58 and when the needle 28 passes through it the sheet 56 frictionally engages the outer surface of that needle 28 and wipes it clean. This is particularly of significance during the withdrawal of the needle 28, because it is when the needle 28 is projected that it is most likely to pick up foreign matter, particularly when it may be projected into a mass of soil or other loose material.

Figure 3:
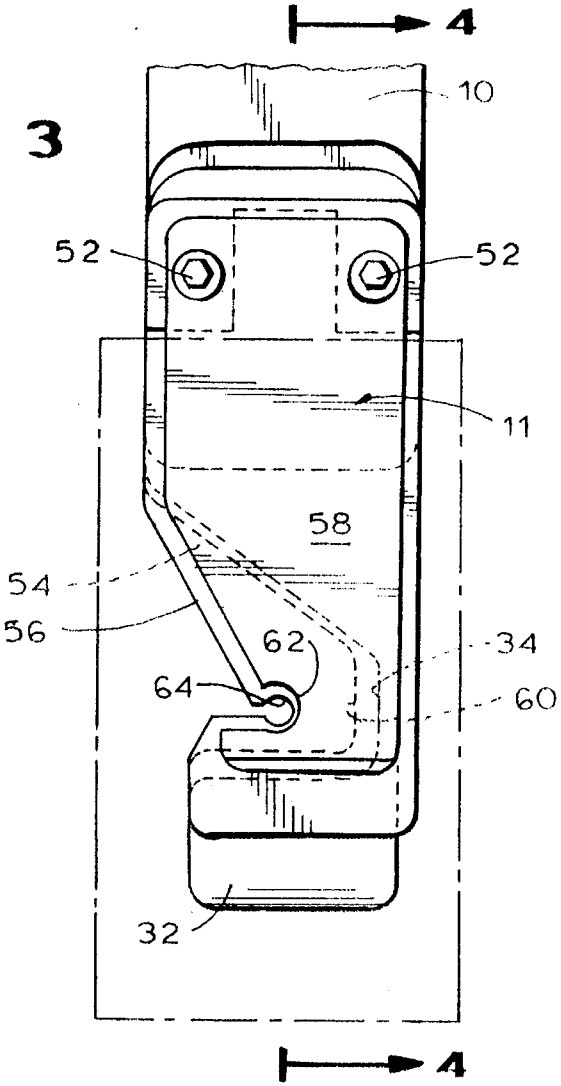
FIG. 3 is a front elevational view on an enlarged scale of the blunt nose of the machine of the present invention.

The metal sheet 58 not only retains the needle-wiping layer 56 in position but also functions to permit the convenient location and accurate positioning of a tag on the apparatus. As shown in FIG. 4, a tag, shown in broken lines and generally designated 66, may be slid up between the neoprene layer 56 and the resilient metal strip 58 until that portion of the tag 66 which is to be penetrated by the needle 28 and the plastic fastener is in line with the needle 28 and the openings 62 and 64. Since those openings are clearly visible, the accurate positioning of the tag 66 on the apparatus is readily, quickly and positively accomplished. Then, after the attaching operation has been completed, that is to say, after the needle 28 has been projected through the openings 34, 60, 64 and 62, carrying with it the head of the plastic fastener, and then after the needle 28 has been withdrawn to its initial position, the machine can be removed from the article to which attachment has been made and the tag and plastic attachment which have been secured to the article simply by moving the apparatus away and without having to exercise any significant degree of care or delicacy, the openings 34, 60, 64 and 62 all being open at the side, as shown in FIG. 3, to permit the filament portion of the plastic attachment to escape from the blunt nose 11 of the attacher.

From the above it can be seen that by reason of the fluid blast and the physical wiping of the needle 28 as it is being retracted, contamination of the attaching apparatus is effectively prevented, and that the physical wiping structure is so designed and arranged as to produce a means to accurately locate a tag in a thoroughly facile and time-saving manner requiring only a minimal degree of care and skill, without interfering with the rapid performance of multiple attaching operations.

While but a single embodiment of the present invention has been here disclosed, it will be apparent that many variations may be made therein, all within the scope of the present invention as defined in the following claims.

We claim:

1. In a fastener attachment insertion device comprising a housing, an abutment member connected to and spaced from said housing and adapted to engage a body to which a fastener is to be attached, and a needle having a tip, said needle being movably mounted on said housing between a first position in which the tip of said needle is between said abutment member and said housing and a second position in which the tip of said needle projects beyond said abutment member, and moving means for moving said needle from said first to said second position and back again, the improvement which comprises blowing means operatively connected to said housing which when activated blows fluid onto said needle, and means for activating said blowing means in synchronism with said moving means, whereby said needle is cleaned by said blown fluid.

2. The device of claim 1, in which said blowing means is actuated at least part of the time when said needle is moving back from its second position to its first position.

3. The device of claim 1, in which said blowing means is actuated while said needle is out of said second position.

4. In a fastener attachment insertion device comprising a housing, an abutment member connected to and spaced from said housing and adapted to engage a body to which a fastener is to be attached, and a needle having a tip of said needle being movably mounted on said housing between a first position in which the tip of said needle is between said abutment member and said housing and a second position in which the tip of said needle projects beyond said abutment member, moving means for moving said needle from said first to said second position and back again, and an element on said housing having a surface which a surface of said needle is adapted to engage and slide over as said needle moves between said first and second positions, thereby to wipe said needle and clean it after use, the improvement which comprises blowing means operatively connected to said housing which when activated blows fluid onto said needle, and means for actuating said blowing means in synchronism with said moving means, whereby said needle is cleaned by said blown fluid.

5. The device of claim 4, in which said blowing means is actuated at least part of the time when said needle is moving back from its second position to its first position.

6. The device of claim 4, in which said blowing means is actuated while said needle is out of said second position.

7. The device of claim 4, in which said element surface is defined by an aperture in a member forming a part of said abutment member, said aperture having at least one dimension closely similar to the corresponding dimension of said needle, through which aperture said needle slides as it moves to and from its second position.

8. The device of claim 4, in which said abutment member comprises a relatively rigid wall through which said needle is adapted to pass, said element comprising a relatively soft part mounted on said wall and having an aperture the dimensions of which closely correspond to the corresponding dimensions of said needle and through which said needle slides as it moves to and from its second position.

* * * * *